US008358789B2

(12) United States Patent
Fischer et al.

(10) Patent No.: US 8,358,789 B2
(45) Date of Patent: Jan. 22, 2013

(54) ADAPTIVE MICROPHONE SYSTEM FOR A HEARING DEVICE AND ASSOCIATED OPERATING METHOD

(75) Inventors: Eghart Fischer, Schwabach (DE); Henning Puder, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 486 days.

(21) Appl. No.: 12/611,972

(22) Filed: Nov. 4, 2009

(65) Prior Publication Data

US 2010/0046776 A1 Feb. 25, 2010

(30) Foreign Application Priority Data

Nov. 4, 2008 (DE) ..... 10 2008 055 760

(51) Int. Cl.
*H04R 3/00* (2006.01)

(52) U.S. Cl. ..... 381/92; 381/94.1

(58) Field of Classification Search ..... 381/92, 381/313, 317, 94.1–9; 379/406.1–16
See application file for complete search history.

(56) References Cited

U.S. PATENT DOCUMENTS 5,473,701 A 12/1995 Cezanne et al.
5,699,480 A * 12/1997 Martin ..... 704/205
5,796,819 A * 8/1998 Romesburg ..... 379/406.09
7,561,700 B1 * 7/2009 Bernardi et al. ..... 381/92
2004/0047474 A1 3/2004 Vries et al.
2004/0204933 A1 * 10/2004 Walker ..... 704/220
2006/0104459 A1 * 5/2006 Fischer et al. ..... 381/92
2007/0076901 A1 4/2007 Fischer et al.

FOREIGN PATENT DOCUMENTS

DE 10327889 B3 9/2004
DE 102004052912 A1 5/2006
EP 1945000 A1 7/2008

* cited by examiner

*Primary Examiner* — Curtis Kuntz
*Assistant Examiner* — Amir Etesam

(57) ABSTRACT

A microphone system and an associated method are proposed. The microphone system comprises at least two omnidirectional, microphone signal-emitting directional microphones connected electrically to one another to establish directivity, at least one filter unit with at least one adaptation parameter for the adaptive filtering of the at least two microphone signals and a control unit to change the at least one adaptation parameter such that the sum of interference power is reduced. The value range of the at least one adaptation parameter is limited. The control unit determines limits from a comparison of the noise floor of the ambient noise with a microphone noise number. The adaptation range of an adaptive differential directional microphone is a function of stationary component of background noise, so the directivity can be selected such that the non-stationary microphone noise resulting due to directivity is masked by the stationary component of the background noise.

12 Claims, 2 Drawing Sheets

ADAPTIVE MICROPHONE SYSTEM FOR A HEARING DEVICE AND ASSOCIATED OPERATING METHOD

CROSS REFERENCE TO RELATED APPLICATIONS

This application claims priority of German application No. 10 2008 052 929.9 filed Nov. 13, 2008, which is incorporated by reference herein in its entirety.

FIELD OF THE INVENTION

The invention relates to a method for suppressing microphone noise and an associated microphone system.

BACKGROUND OF THE INVENTION

With acoustic systems and in particular with hearing devices, it is advantageous to combine a number of microphone signals and filter them spatially and spectrally so that the output signal contains as few interference components as possible. Interference here is defined on the one hand as signals, which are incident from unwanted directions, for example outside a predetermined angle range around the 0° direction, and on the other hand as microphone noise, which is amplified in low-frequency ranges in particular when establishing the directivity. The problem arises in particular that microphone noise increases, when the directivity of a directional microphone is enhanced.

In DE 10 2004 052 912 A1 an acoustic system and a method are specified, which suppress interference power in directional microphones as far as possible. To this end the microphone signals of a number of microphones are filtered adaptively as a function of at least one parameter. The directivity of the directional microphone thus obtained is adjusted by changing the at least one parameter so that the sum of interference power including microphone noise is reduced or minimal. There is therefore a switch between directional operation and omnidirectional operation depending on noise distribution.

The method described in DE 10 2004 062 912 A1 results in minimization of the total power made up of microphone noise and ambient noise. Half of residual noise consists of residual ambient noise and half of residual microphone noise. Mathematically speaking the overall interference is minimal, but not for the subjective sound impression of a user of the acoustic system. Rapidly changing signal components and broad partial band signals mean that disruptive microphone noise is repeatedly perceptible for the user. Non-stationary interferers in particular, such as speech, cause a brief switch to directional operation. If the interferer then becomes inactive again, there is a delayed switch to omnidirectional operation, so that noise tails are briefly audible.

SUMMARY OF THE INVENTION

The object of the invention is to overcome the disadvantages and specify an apparatus and an associated method, which prevent perceptible microphone noise.

According to the invention the specified object is achieved with the method for operating a microphone system and the microphone system in the claims.

The invention specifies a method for operating a microphone system with at least two omnidirectional, microphone signal-emitting directional microphones, the microphones being connected electrically to one another to establish directivity. The method comprises the following steps:

- adaptive filtering of the at least two microphone signals with at least one adaptation parameter,
- adjusting the directivity by changing the at least one adaptation parameter so that the sum of interference power is minimized, and
- limiting the value range of the at least one adaptation parameter, with the limits being determined from a comparison of the noise floor of ambient noise with a microphone noise figure.

This has the advantage that the adaptation range of an adaptive differential directional microphone is a function of the stationary component of the background noise, so the directivity is always selected such that the non-stationary microphone noise resulting due to directivity is almost always masked by the stationary component of the background noise. A quieter sound impression without noise artifacts is thus achieved with the maximum possible directivity in a manner tailored to the situation.

In one development the method can be executed separately for a number of partial frequency bands. This provides better directivity whilst at the same time suppressing noise tail.

In a further embodiment the noise floor can be determined with the aid of Wiener filters or non-linear power estimators. This has the advantage of simple and robust noise power determination.

The value of the microphone noise number can also be predetermined as a function of the microphone, with a data sheet value of the microphone noise of the microphones and at least one distance between the microphones being taken into account. This has the advantage that microphone-specific parameters are used.

In one development the interference power can comprise microphone noise amplified by directivity and power from unwanted signal sources.

The value range can advantageously be selected so that the microphone noise amplified by directivity is masked by the stationary component of the background noise.

The invention also specifies a microphone system with at least two omnidirectional, microphone signal-emitting microphones, the microphones being connected electrically to one another to establish directivity. The microphone system comprises at least one filter unit with at least one adaptation parameter for the adaptive filtering of the at least two microphone signals to achieve directivity and a control unit, which can be used to change the at least one adaptation parameter such that the sum of interference power is reduced. The value range of the at least one adaptation parameter is limited, with the control unit determining the limits from a comparison of the noise floor of the ambient noise with a microphone noise number.

In one development the at least one filter unit can have separate filters for a number of partial frequency bands, so that the change to the at least one adaptation parameter can be executed separately in a number of partial frequency bands.

In a further embodiment the noise floor can be determined in the control unit with the aid of Wiener filters or non-linear power estimators.

The value of the microphone noise number can advantageously be predetermined in the control unit as a function of the microphone, with a data sheet value of the microphone noise of the microphones and at least one distance between the microphones being taken into account.

The interference power can also comprise microphone noise amplified by directivity and power from unwanted signal sources.

In one development the control unit can select the value range such that the stationary component of the background noise masks the microphone noise amplified by the directivity.

The invention also claims a hearing device with an inventive microphone system for executing an inventive method. This has the advantage that hearing device users no longer perceive the resulting microphone noise perceptively.

BRIEF DESCRIPTION OF THE DRAWINGS

Further particular features and advantages of the invention will emerge from the descriptions which follow of an exemplary embodiment with reference to schematic drawings, in which.

DETAILED DESCRIPTION OF THE INVENTION

Figure 1:
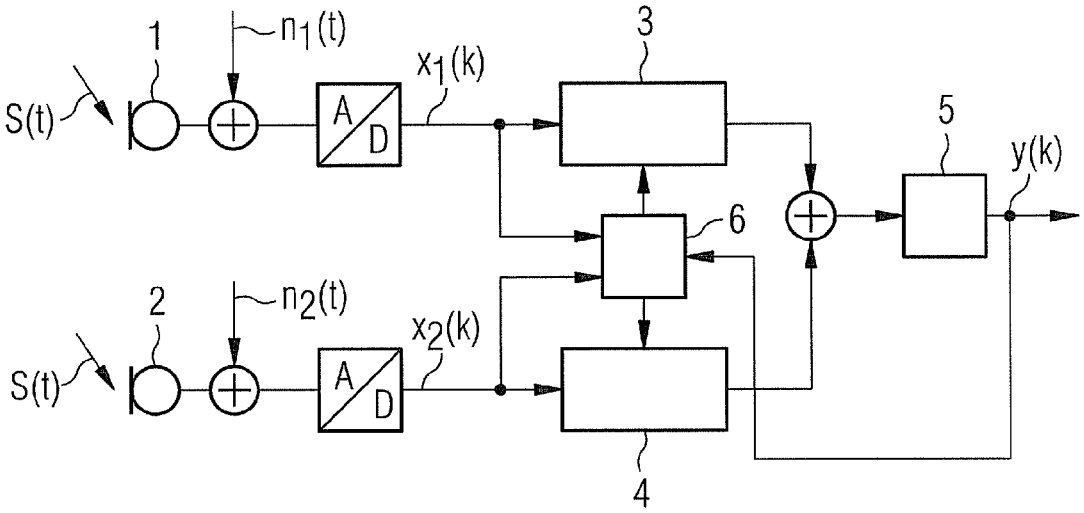
FIG. 1: shows a basic circuit diagram of a first-order microphone system.

FIG. 1 shows a first-order differential microphone. Two microphones 1, 2 receive a time-dependent sound signal s(t). Mixed with the ideal microphone signals in each instance is a microphone noise signal $n_1(t)$ or $n_2(t)$. The respective sum signals are digitized using an analog/digital converter, thus supplying the digital, noise-affected microphone signals $x_1(k)$ and $x_2(k)$.

It is known, but not shown in FIG. 1, that to achieve directivity the two microphone signals $x_1(k)$ and $x_2(k)$ can be subtracted crosswise. In this process the signals in the corresponding paths are delayed with time elements and a differential signal is multiplied by an adaptation parameter a. The resulting signals are added together and supplied for equalization in the useful signal direction to an equalizer 5 with a transmission function H(z)=

$$\frac{1}{1-z^{-2}}.$$

Equalization supplies a mono output signal y(k).

The first-order differential microphone can however also be realized as shown in FIG. 1 by two FIR filter units 3, 4 with the transmission functions $1+az^{-1}$ and $-a-z^{-1}$. The filter coefficients cannot be freely selected here but are a function of the adaptation parameter a. This dependency, which results from calculating filtering from the differential microphone, ensures that the output signal after directional microphone processing contains the signal from the 0° direction (useful signal direction) unchanged, regardless of the selection of the parameter a. To optimize the adaptation parameter a, it is tailored to the respective acoustic situation. Where a=−1, no directivity is present, the microphone system has an omnidirectional character; where a=−0, the sound from the direction 180° is attenuated and as a increases, the notches (=directions of greatest attenuation) migrate forward in the directional diagram. The value of the adaptation parameter a is supplied from an output of a control unit 6 to the filter units 3, 4.

Figure 2:
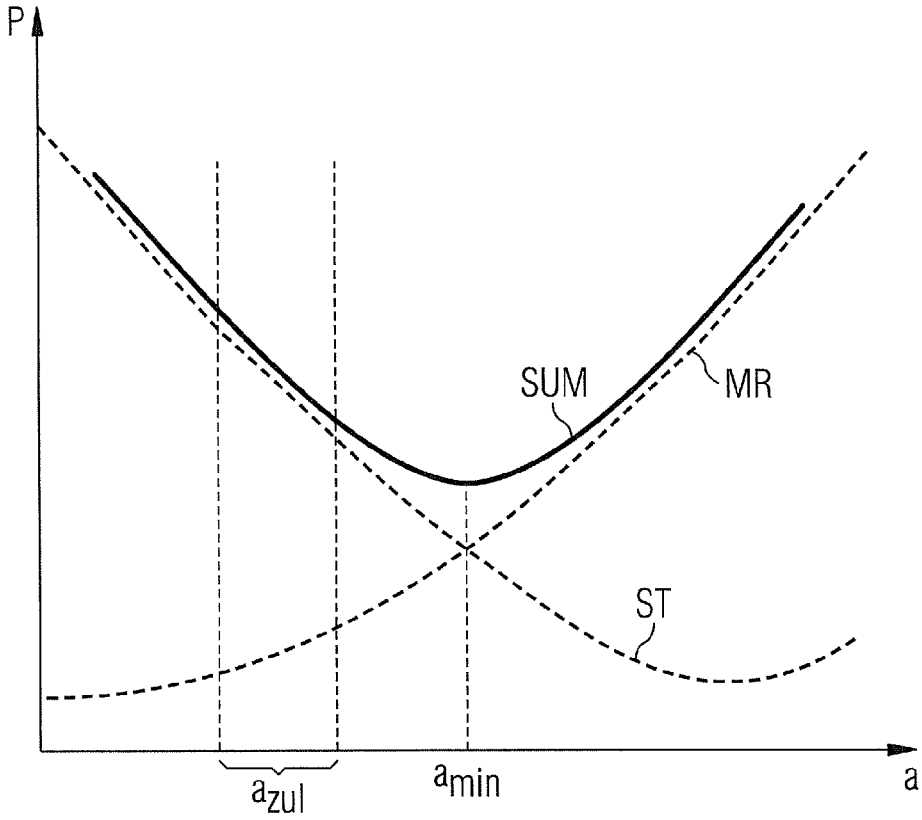
FIG. 2: shows a diagram for optimizing the adaptation parameter.

With greater directivity, in other words as a increases, microphone noise also increases. It is however desirable for the overall interference power of a directional microphone to be as small as possible. Therefore on the one hand the directivity of the directional microphone should be adjusted so that the sound from an interference source is suppressed as effectively as possible and on the other hand microphone noise should be kept as low as possible. In FIG. 2 for greater clarity the power of the interference signal ST and the microphone noise MR are plotted qualitatively over the adaptation parameter a. A sum signal SUM of the two signals ST and MR represents the overall interference power for the directional microphone. With known methods, as disclosed for example in DE 10 2004 052 912 A1, it is possible to find the minimum of the sum curve SUM and insert the corresponding parameter value $a_{min}$ for the adaptive filters 3, 4.

Adaptation of the directional microphone to a specific interference source and/or optimization of the parameter a can take place for example by means of a gradient method comparable to the LMS (Least Mean Squares) method. However other variants are also possible. In the case of the gradient method the adaptation condition is very simple. It can be determined by minimizing the mean output signal power of the directional microphone. To this end, as shown in FIG. 1, the output signal y(k) is supplied to the control unit 6.

Minimization of the mean output signal power for adapting the directional microphone is only possible, because the specific selection of the filter coefficients as a function of the parameter a ensures that the useful signal from the 0° direction is not changed. Minimization of the overall power (=useful signal+interference) is thus equivalent to minimization of the power of the interference. The interference here is made up of two components: microphone noise and interference from signal sources that are incident from unwanted directions. Attenuation of direction-dependent signal sources can be achieved by selecting the parameter a>0. Limiting to a maximum value, for example a=2, determines the range in the 0° direction—in this instance +/−60°—in which incident signal sources are not or are only slightly attenuated. If it is also permitted for the adaptive method to select the parameter a also as less than 0, the directivity is reduced but the power of the microphone noise is also diminished as a result. Where a=−1, there is no longer any directivity and the microphone system of the microphones 1, 2 operates in an exclusively omnidirectional manner.

By adapting the parameter a in individual frequency bands the method is able to minimize the sum of the interference power, i.e. microphone noise and signal sources from unwanted directions, in every frequency band.

This adaptation has the disadvantage that because of a finite processing time with rapidly changing interference signals, for example speech from an unwanted direction, the adaptation parameter a cannot be corrected so quickly to suppress unwanted microphone noise. This means that microphone noise is disruptively audible to a user as so-called noise tails for a brief period. This is where the invention comes into play. Microphone noise is suppressed at the cost of reduced directivity, in that the range that the adaptation parameter a can assume is limited as a function of ambient noise. This allows the disruptive noise tails to be masked by ambient noise. The limiting of the adaptation parameter a is shown in FIG. 2 by $a_{perm}$.

Figure 3:
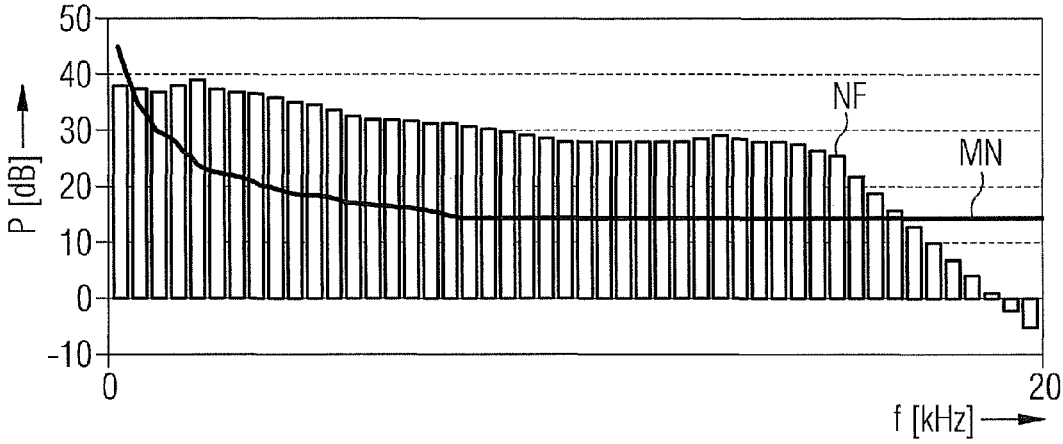
FIG. 3: shows a pattern of the noise floor and the microphone noise as a function of frequency
Figure 4:
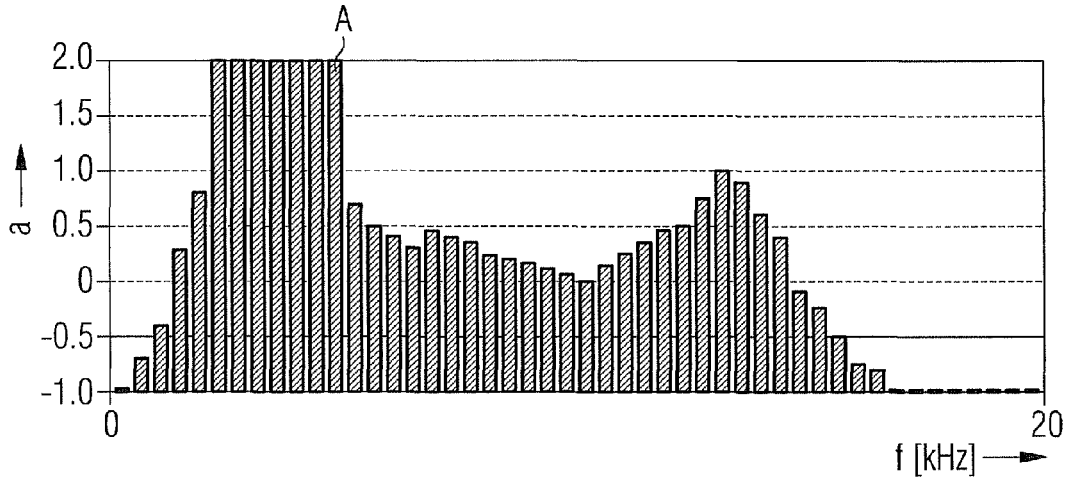
FIG. 4: shows a pattern of the limit value of the adaptation parameter as a function of frequency.

The invention is described in more detail with the aid of the diagrams in FIGS. 3 and 4. According to FIG. 3 a stationary noise floor NF of the ambient noise is inventively first determined in 48 partial signal bands. This is shown as a bar chart with the signal power P in dB. To determine the ambient noise NF, as shown in FIG. 1, the microphone signals $x_1(k)$ and $x_2(k)$ are supplied to inputs of the control unit 6. Data sheet values of the microphones 1,2 and the distance between the two microphones 1, 2 are used to determine a theoretical value of the microphone noise MN, also referred to as the microphone noise number, as a function of the frequency f.

In a further step the range of the adaptation of the parameter a is limited upward as a function of the frequency f such that it is no longer possible for the adaptation to select the directional microphone setting so that the resulting microphone noise is above the measured noise floor NF, i.e. can be perceived perceptively by the user. FIG. 4 shows the limit value A of the adaptation parameter a as a function of the 48 partial signal bands in the form of vertical bars. a=−1 always applies for the lower limit. It can be seen from FIGS. 3 and 4 that for smaller differences made up of ambient noise NF and microphone noise MN the upper limit value A of the adaptation parameter a becomes smaller.

The inventive step involves using the noise floor NF to activate directional microphone mode in the individual bands, rather than the overall signal level or the interference signal level. This ensures that brief non-stationary interferers do not cause a switch to directional microphone mode and thus to perceptible microphone noise, for example due to noise tails. To calculate the noise floor NF in the individual bands it is possible to use methods known from Wiener filter-based, single-channel noise reduction or non-linear power estimators, which track rising level values more slowly than falling ones.

A similar structure and method are used for higher-order directional microphones. One preferred application for the microphone system and associated method is with hearing devices.

LIST OF REFERENCE CHARACTERS

1, 2 Microphone
3, 4 Filter unit
5 Equalizer
6 Control unit
a Adaptation parameter
$a_{min}$ Minimal adaptation parameter a
$a_{perm}$ Permissible adaptation parameter a
A Limit value of adaptation parameter a
f Frequency
MR Microphone noise
MN Microphone noise number
$n_1(t)$, $n_2(t)$ Microphone noise signal
NF Noise floor
P Interference power
SUM Sum noise
ST Interference noise
$x_1(k)$, $x_2(k)$ Microphone signal
y(k) Output signal

The invention claimed is:

1. A method for operating a microphone system having at least two omnidirectional microphones emitting at least two microphone signals, the at least two omnidirectional microphones being electrically connected to one another to establish a directivity, the method comprising the steps of:

adaptively filtering the at least two microphone signals with at least one adaptation parameter by a filter unit;

adjusting the directivity by changing the at least one adaptation parameter for minimizing a sum of an interference power by a control unit;

comparing a noise floor of an ambient noise with a microphone noise number by the control unit; and determining a limit of a value range of the at least one adaptation parameter from the comparison by the control unit, wherein the value range is determined so that a microphone noise amplified by the directivity is masked by a stationary component of the noise floor.

2. The method as claimed in claim 1, wherein the method is executed separately for a number of partial frequency bands.

3. The method as claimed in claim 1, wherein the noise floor is determined by Wiener filters or non-linear power estimators.

4. The method as claimed in claim 1, wherein the microphone noise number is predetermined as a function of the microphone noise of the at least two omnidirectional microphones considering a distance between the at least two omnidirectional microphones.

5. The method as claimed in claim 1, wherein the interference power comprises the microphone noise amplified by the directivity and a power from unwanted signal sources.

6. A microphone system, comprising:

at least two omnidirectional directional microphones that emit at least two microphone signals, the at least two omnidirectional directional microphones being electrically connected to one another to establish a directivity;

at least one filter unit with at least one adaptation parameter that adaptively filters the at least two microphone signals to achieve the directivity; and a control unit that:

compares a noise floor of an ambient noise with a microphone noise number, determines a limit of a value range of the at least one adaptation parameter from the comparison, and changes the at least one adaptation parameter for reducing a sum of an interference power, wherein the value range is determined so that a microphone noise amplified by the directivity is masked by a stationary component of the noise floor.

7. The microphone system as claimed in claim 6, wherein the at least one filter unit comprises a plurality of separate filters for a number of partial frequency bands.

8. The microphone system as claimed in claim 7, wherein the control unit separately changes the at least one adaptation parameter in the number of partial frequency bands.

9. The microphone system as claimed in claim 6, wherein the control unit determines the noise floor by Wiener filters or non-linear power estimators.

10. The microphone system as claimed in claim 6, wherein the microphone noise number is predetermined as a function of the microphone noise of the at least two omnidirectional directional microphones considering a distance between the at least two omnidirectional directional microphones.

11. The microphone system as claimed in claim 6, wherein the interference power comprises the microphone noise amplified by the directivity and a power from unwanted signal sources.

12. A hearing device, comprising:

at least two omnidirectional directional microphones that emit at least two microphone signals, the at least two omnidirectional directional microphones being electrically connected to one another to establish a directivity;

at least one filter unit with at least one adaptation parameter that adaptively filters the at least two microphone signals to achieve the directivity;

a control unit that:

compares a noise floor of an ambient noise with a microphone noise number, determines a limit of a value range of the at least one adaptation parameter from the comparison, and changes the at least one adaptation parameter for reducing a sum of an interference power; and an equalizer that receives the adaptively filtered at least two microphone signals, wherein the value range is determined so that a microphone noise amplified by the directivity is masked by a stationary component of the noise floor.

* * * * *